US011854732B2

(12) United States Patent
Hayama et al.

(10) Patent No.: US 11,854,732 B2
(45) Date of Patent: Dec. 26, 2023

(54) COIL COMPONENT

(71) Applicant: TDK Corporation, Tokyo (JP)

(72) Inventors: Junpei Hayama, Tokyo (JP); Noritaka Chiyo, Tokyo (JP); Shigeru Kaneko, Tokyo (JP); Tomohiro Moriki, Tokyo (JP); Takahiro Ohishi, Tokyo (JP); Toshio Tomonari, Tokyo (JP)

(73) Assignee: TDK Corporation, Tokyo (JP)

( * ) Notice: Subject to any disclaimer, the term of this patent is extended or adjusted under 35 U.S.C. 154(b) by 910 days.

(21) Appl. No.: 16/668,700

(22) Filed: Oct. 30, 2019

(65) Prior Publication Data

US 2020/0135382 A1 Apr. 30, 2020

(30) Foreign Application Priority Data

Oct. 31, 2018 (JP) ..... 2018-205187

(51) Int. Cl.
*H01F 27/28* (2006.01)
*H01F 27/06* (2006.01)
*H01F 41/04* (2006.01)

(52) U.S. Cl.
CPC ..... *H01F 27/2804* (2013.01); *H01F 27/06* (2013.01); *H01F 41/041* (2013.01); *H01F 2027/2809* (2013.01)

(58) Field of Classification Search
CPC ..... H01F 17/0013; H01F 2027/2809; H01F 17/0006; H01F 27/2804; H01F 5/003; H01F 27/29; H01F 27/292; H01F 2017/0073; H01F 2017/0046; H01F 27/006; H01F 27/04; H01F 27/06
USPC ..... 336/192, 200, 232
See application file for complete search history.

(56) References Cited

U.S. PATENT DOCUMENTS

| | | | | |
|---|---|---|---|---|
| 7,417,523 | B2 * | 8/2008 | Waffenschmidt | H05K 1/165 336/200 |
| 2009/0309579 | A1 * | 12/2009 | Cochran | A61B 5/113 324/207.16 |
| 2011/0133877 | A1 * | 6/2011 | Chiu | H01F 17/0013 336/200 |
| 2013/0293337 | A1 * | 11/2013 | Lo | H01F 41/041 336/200 |
| 2016/0094082 | A1 | 3/2016 | Ookawa et al. | |

FOREIGN PATENT DOCUMENTS

| | | | | |
|---|---|---|---|---|
| JP | 06236821 | A * | 8/1994 | |
| JP | 07-37728 | A | 2/1995 | |
| JP | 2001-319813 | A | 11/2001 | |
| JP | 2003-197438 | A | 7/2003 | |
| JP | 2008-205215 | A | 9/2008 | |
| WO | WO-9843258 | A2 * | 10/1998 | H01F 17/0006 |

* cited by examiner

*Primary Examiner* — Tszfung J Chan
(74) *Attorney, Agent, or Firm* — Rimon P.C.; Tomoki Tanida

(57) ABSTRACT

Disclosed herein is an apparatus that includes a substrate having first and second surfaces opposite to each other, a first coil pattern formed on the first surface of the substrate, and a second coil pattern formed on the second surface of the substrate. The first coil pattern includes first and second lines, and the second coil pattern includes third and fourth lines. The first line is greater in a number of turn than the second line, and the third line is greater in a number of turn than the fourth line. The first line is connected to the fourth line, and the third line is connected to the second line.

9 Claims, 13 Drawing Sheets

COIL COMPONENT

BACKGROUND OF THE INVENTION

Field of the Invention

The present invention relates to a coil component and, more particularly, to a coil component having a spiral-shaped planar conductor.

Description of Related Art

As a coil component used for various electronic devices, a coil component of a type in which a wire (coated wire) is wound around a magnetic core and, further, a coil component of a type in which a spiral-shaped planar conductor of a plurality of turns is formed on the surface of an insulating layer are known. For example, JP 2008-205215 A discloses a coil component having a configuration in which spiral-shaped coil parts are formed respectively on a plurality of insulating layers, and the inner peripheral ends thereof are connected to one another.

In order to reduce DC resistance or AC resistance in a coil component constituted by a spiral-shaped planar conductor, the conductor width of the spiral-shaped planar conductor may be increased. However, simply increasing the conductor width of the planar conductor increases non-uniformity in distribution of current density, making it difficult to sufficiently reduce DC resistance or AC resistance.

To make the current density uniform, there is known a method of dividing each turn of the planar conductor into a plurality of lines by a spiral-shaped slit (JP 2001-319813 A). In the example described in JP 2001-319813 A, the plurality of lines obtained are short-circuited at their inner peripheral ends, so that even when the inner peripheral ends of the plurality of planar conductors are connected as in the technique described in JP 2008-205215 A, it is sufficient to use only one connection conductor.

However, when a separate connection conductor is provided for each line so as to make the current density more uniform, the plurality of connection conductors are concentrated on one position. Therefore, in this case, the problem is how to arrange these connection conductors.

SUMMARY

It is therefore an object of the present invention to increase the degree of freedom of the layout of connection conductors in a coil component having two coil part each of which is divided into a plurality of lines and whose inner peripheral ends are connected to each other.

A coil component according to the present invention includes a first coil part spirally wound in a plurality of turns and a second coil part spirally wound in a plurality of turns. At least the innermost peripheral turn of the first coil part is divided into a plurality of lines including first and second lines by a spiral-shaped slit, and at least the innermost peripheral turn of the second coil part is divided into a plurality of lines including third and fourth lines by a spiral-shaped slit. The innermost peripheral turn of the first line is larger in angular distance than the innermost peripheral turn of the second line, and the innermost peripheral turn of the third line is larger in angular distance than the innermost peripheral turn of the fourth line. The inner peripheral end of the first line is connected to the inner peripheral end of the fourth line, and the inner peripheral end of the second line is connected to the inner peripheral end of the third line.

According to the present invention, the two lines each constituting the innermost peripheral turn differ from each other in angular distance, so that connection conductors can be arranged in a distributed manner. This can increase the degree of freedom of the layout of the connection conductors. In addition, a line with a large angular distance in one coil part and a line with a small angular distance in the other coil part are connected to each other, so that there occurs no difference in the number of turns between the lines.

In the present invention, the first line may be positioned peripherally outside the second line, and the third line may be positioned peripherally outside the fourth line. This eliminates an inner and outer peripheral difference between the lines to thereby make current density distribution uniform. As a result, it is possible to reduce DC resistance or AC resistance.

In the present invention, at least the innermost peripheral turn of each of the first and second coil parts may be divided into n lines. The total angular distance of the n lines constituting the innermost peripheral turn of the first coil part may be n/2 turns, and the total angular distance of the n lines constituting the innermost peripheral turn of the second coil part may be n/2 turns. This can make the total number of turns of the first and second coil parts odd.

In the present invention, at least the innermost peripheral turn of the first coil part may be divided into two lines including first and second lines, and at least the innermost peripheral turn of the second coil part may be divided into two lines including third and fourth lines. The innermost peripheral turns of the respective first and third lines may each be ¾ turns, and the innermost peripheral turns of the respective second and fourth lines may each be ¼ turns. Thus, overlapping the first and second coil parts allows the planar positions of the inner peripheral end of the first line and the inner peripheral end of the fourth line to coincide with each other and the planar positions of the inner peripheral end of the second line and the inner peripheral end of the third line to coincide with each other. Thus, the inner peripheral ends of the first and fourth lines can be easily connected to each other, and the inner peripheral ends of the second and third lines can be easily connected to each other.

In the present invention, at least the innermost peripheral turn of the first coil part may be divided into three lines including first, second and fifth lines, and at least the innermost peripheral turn of the second coil part may be divided into three lines including third, fourth and sixth lines. Any one of the first, second and fifth lines may be ½ turns, and the remaining two thereof may be one turn in total. Any one of the third, fourth, and sixth lines may be ½ turns, and the remaining two thereof may be one turn in total. Thus, it is possible to make the total number of turns odd while making the total length of the three lines coincide between the first and second coil parts.

In this case, any one of the first, second and fifth lines may be radially sandwiched between the remaining two thereof, and any one of the third, fourth and sixth lines may be radially sandwiched between the remaining two thereof. This eliminates an inner and outer peripheral difference to make current density distribution more uniform. As a result, it is possible to further reduce DC resistance or AC resistance.

In the present invention, at least the innermost peripheral turn of the first coil part may be divided into four lines including first, second, fifth and seventh lines, and at least the innermost peripheral turn of the second coil part may be divided into four lines including third, fourth, sixth and eighth lines. Any two of the first, second, fifth and seventh lines may be one turn in total, and the remaining two thereof may be one turn in total. Any two of the third, fourth, sixth and eighth lines may be one turn in total, and the remaining two thereof may be one turn in total. Thus, it is possible to make the total number of turns odd while making the total length of the four lines coincide between the first and second coil parts.

In the present invention, the first coil part may be formed on one surface of an insulating substrate, and the second coil part may be formed on the other surface of the insulating substrate. Thus, forming the first and second coil parts on the front and back surfaces of a single insulating substrate allows the coil component according to the present invention to be produced.

In the present invention, a plurality of turns constituting each of the first and second coil parts may each have a circumferential region in which the radial position is not changed and a shift region in which the radial position is shifted, and the circumferential region of the plurality of turns constituting the first coil part and the circumferential region of the plurality of turns constituting the second coil part may coincide with each other in planar position. This facilitates appearance inspection regardless of whether the insulating substrate is transparent or translucent.

Thus, according to the present invention, it is possible to increase the degree of freedom of the layout of connection conductors and to make the total number of turns equal between the lines in a coil component having two coil parts each of which is divided into a plurality of lines.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

First Embodiment

Figure 1:
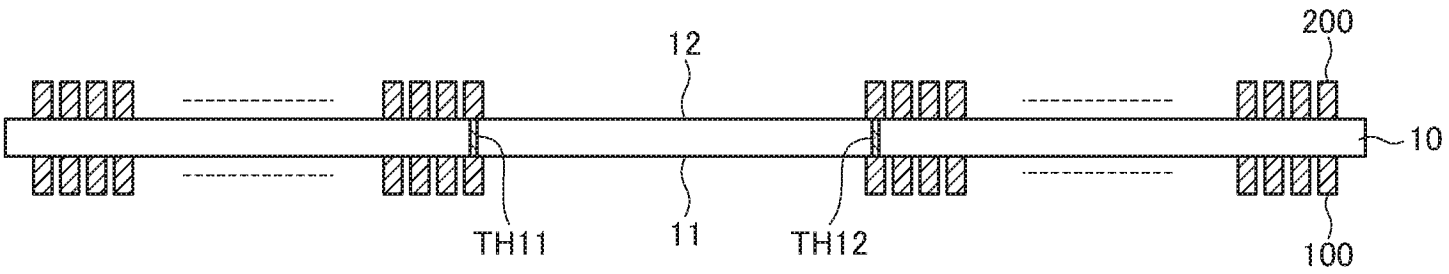
FIG. 1 is a cross-sectional view illustrating the configuration of a coil component according to a first embodiment of the present invention.

FIG. 1 is a cross-sectional view illustrating the configuration of a coil component according to the first embodiment of the present invention.

As illustrated in FIG. 1, the coil component according to the present embodiment includes an insulating substrate 10, a first coil part 100 formed on one surface 11 of the insulating substrate 10, and a second coil part 200 formed on the other surface 12 of the insulating substrate 10. Although details will be described later, the inner peripheral end of the first coil part 100 and the inner peripheral end of the second coil part 200 are connected to each other through connection conductors TH11 and TH12 penetrating the insulating substrate 10.

The material of the insulating substrate 10 can be, but not limited thereto, a transparent or translucent flexible material such as PET resin. Alternatively, the insulating substrate 10 may be a flexible substrate obtained by impregnating glass cloth with epoxy-based resin. When the insulating substrate 10 is made of a transparent or translucent material, the first coil part 100 and the second coil part 200 overlap each other in appearance when viewed in a plan view, which may make appearance inspection using an inspection apparatus difficult depending on how they overlap each other. Although details will be described later, in the coil component according to the present embodiment, the first and second coil parts 100 and 200 are disposed such that they almost entirely overlap each other in a plan view so as to allow appearance inspection using an inspection apparatus to be properly conducted.

Figure 2:
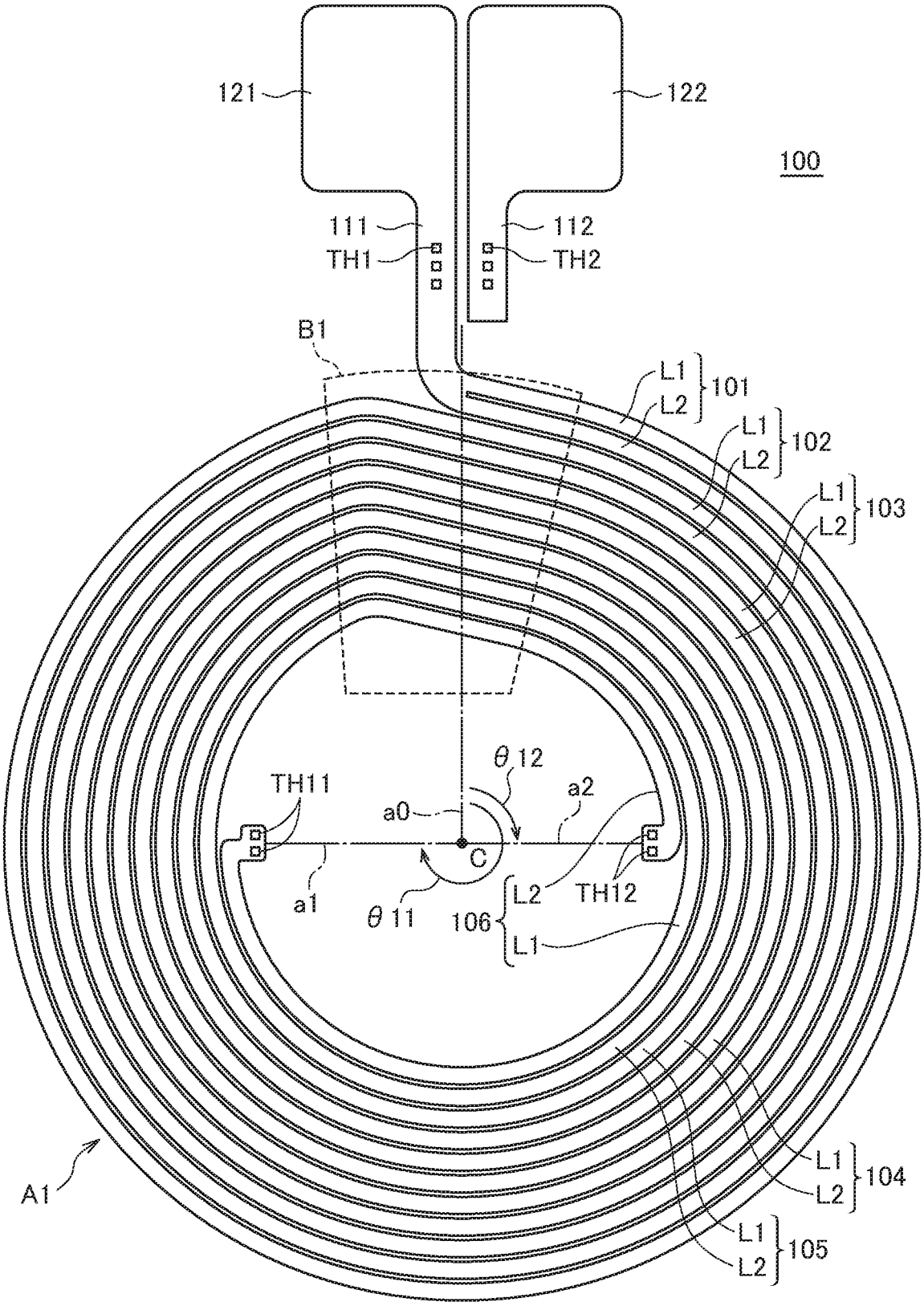
FIG. 2 is a plan view for explaining the pattern shape of the first coil part included in the first embodiment of the present invention as viewed from one surface side of the insulating substrate.

FIG. 2 is a plan view for explaining the pattern shape of the first coil part 100 as viewed from the one surface 11 side of the insulating substrate 10.

As illustrated in FIG. 2, the first coil part 100 is constituted by a planar conductor spirally wound in a plurality of turns. In the example illustrated in FIG. 2, the first coil part 100 has six turns including turns 101 to 106, in which the turn 101 is positioned at the outermost periphery, and turn 106 is at the innermost periphery. The turns 101 to 106 are each divided into lines L1 and L2 by a spiral-shaped slit. The line L1 is positioned peripherally outside the line L2.

The outer peripheral end of the first coil part 100, i.e., the outer peripheral end of the turn 101 is connected to a terminal electrode 121 through a radially extending lead-out pattern 111. Further, a radially extending lead-out pattern 112 is disposed at a position peripherally adjacent to the lead-out pattern 111. The leading end of the lead-out pattern 112 is connected to a terminal electrode 122.

As illustrated in FIG. 2, the turns 101 to 105 constituting the first coil part 100 are each wound one round (360°). On the other hand, in the turn 106 positioned at the innermost periphery, an angular distance θ11 of the line L1 is ¾ turns (270°), and an angular distance θ12 of the line L2 is ¼ turns (90°). Accordingly, the total number of turns of the innermost peripheral turns of the lines L1 and L2 is one turn. The angular distance θ11 is an angle formed by a virtual line a0 and a virtual line a1, and the angular distance θ12 is an angle formed by the virtual line a0 and a virtual line a2. The virtual lines a0 to a2 radially extend from a center point C. The virtual line a0 passes between the lead-out patterns 111 and 112, the virtual line a1 passes through the inner peripheral end of the line L1, and the virtual line a2 passes through the inner peripheral end of the line L2. Two connection conductors TH11 are provided at the inner peripheral end of the line L1 of the turn 106, and two connection conductors TH12 are provided at the inner peripheral end of the line L2 of the turn 106.

The turns 101 to 106 constituting the first coil part 100 each have a circumferential region A1 in which the radial position is not changed and a shift region B1 in which the radial position is shifted. The six turns including the turns 101 to 106 are defined with the shift region B1 as a boundary. As illustrated in FIG. 2, in the present embodiment, the outer peripheral end of the first coil part 100 is positioned within the shift region B1. The positional relationship between the lead-out patterns 111 and 112 may be reversed to that illustrated in FIG. 2.

Figure 3:
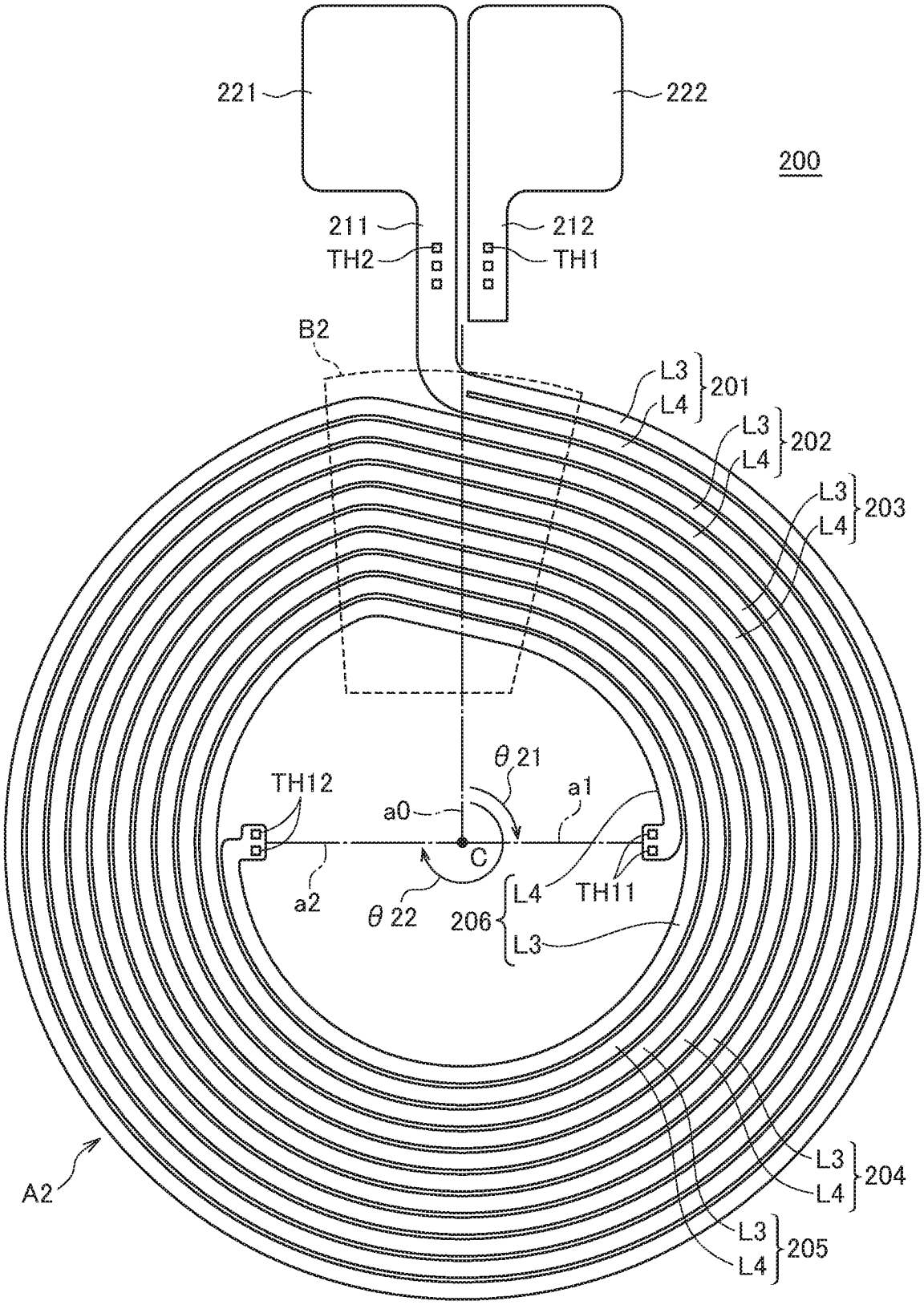
FIG. 3 is a plan view for explaining the pattern shape of the second coil part included in the first embodiment of the present invention as viewed from the other surface side of the insulating substrate.

FIG. 3 is a plan view for explaining the pattern shape of the second coil part 200 as viewed from the other surface 12 side of the insulating substrate 10.

As illustrated in FIG. 3, the second coil part 200 has the same pattern shape as the first coil part 100. Thus, the first and second coil parts 100 and 200 can be produced using the same mask, whereby production cost can be significantly reduced. The second coil part 200 has six turns including turns 201 to 206, in which the turn 201 is positioned at the outermost periphery, and the turn 206 is at the innermost periphery. The turns 201 to 206 are each divided into lines L3 and L4 by a spiral-shaped slit. The line L3 is positioned peripherally outside the line L4.

The outer peripheral end of the second coil part 200, i.e., the outer peripheral end of the turn 201 is connected to a terminal electrode 221 through a radially extending lead-out pattern 211. Further, a radially extending lead-out pattern 212 is disposed at a position peripherally adjacent to the lead-out pattern 211. The leading end of the lead-out pattern 212 is connected to a terminal electrode 222.

As illustrated in FIG. 3, the turns 201 to 205 constituting the second coil part 200 are each wound one round (360°). On the other hand, in the turn 206 positioned at the innermost periphery, an angular distance θ22 of the line L3 is ¾ turns (270°), and an angular distance θ21 of the line L4 is ¼ turns (90°). Accordingly, the total number of turns of the innermost peripheral turns of the lines L3 and L4 is one turn. The angular distance θ21 is an angle formed by the virtual line a0 and virtual line a1, and the angular distance θ22 is an angle formed by the virtual line a0 and virtual line a2. The two connection conductors TH12 are provided at the inner peripheral end of the line L3 of the turn 206, and the two connection conductors TH11 are provided at the inner peripheral end of the line L4 of the turn 206.

The turns 201 to 206 constituting the second coil part 200 each have a circumferential region A2 in which the radial position is not changed and a shift region B2 in which the radial position is shifted. The six turns including the turns 201 to 206 are defined with the shift region B2 as a boundary. As illustrated in FIG. 3, in the present embodiment, the outer peripheral end of the second coil part 200 is positioned within the shift region B2. The positional relationship between the lead-out patterns 211 and 212 may be reversed to that illustrated in FIG. 3.

The thus configured first and second coil parts 100 and 200 are formed on the one surface 11 and the other surface 12 of the insulating substrate 10, respectively. The inner peripheral end of the line L1 is connected to the inner peripheral end of the line L4 through the connection conductor TH11, and the inner peripheral end of the line L2 is connected to the inner peripheral end of the line L3 through the connection conductor TH12.

Figure 4:
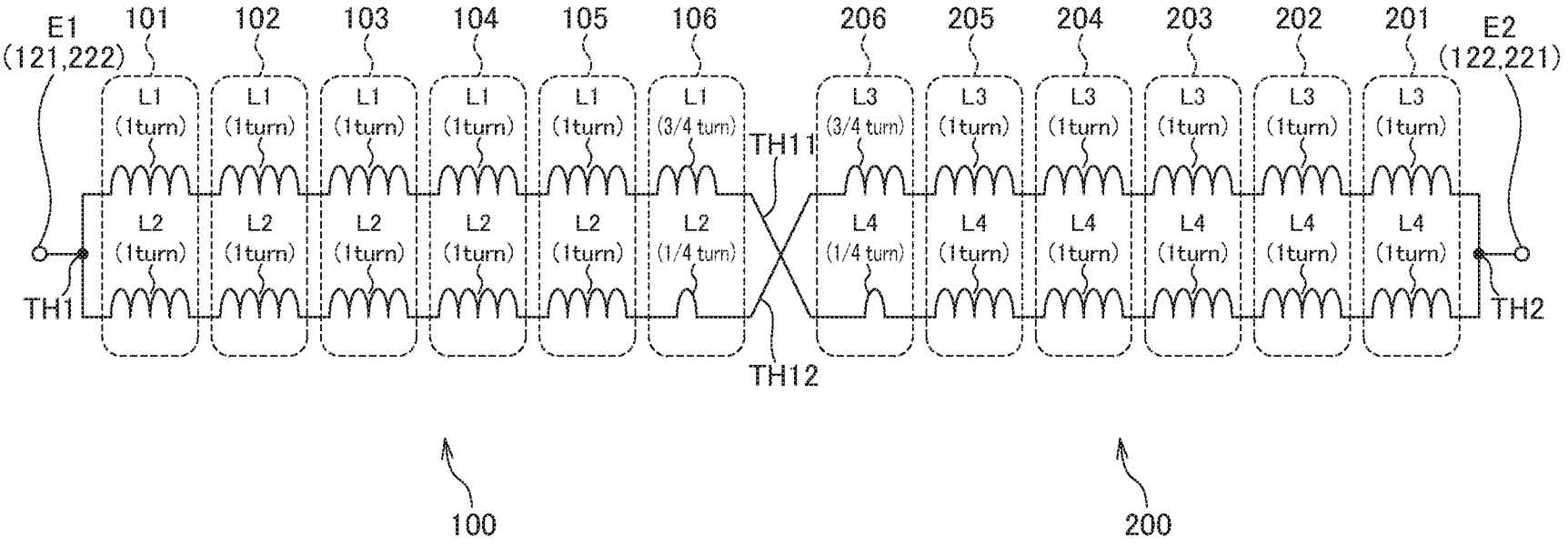
FIG. 4 is an equivalent circuit diagram of the coil component according to the first embodiment of the present invention.

FIG. 4 is an equivalent circuit diagram of the coil component according to the present embodiment.

As illustrated in FIG. 4, in the present embodiment, two conductive patterns are connected in parallel between terminal electrodes E1 and E2. The terminal electrode E1 is a terminal in which the terminal electrodes 121 and 222 are short-circuited by the connection conductor TH1, and the terminal electrode E2 is a terminal in which the terminal electrodes 122 and 221 are short-circuited by the connection conductor TH2. Of the two parallel-connected conductive patterns, the first conductive pattern includes the lines L1 and L4 connected through the connection conductor TH11, and the second conductive pattern includes the lines L2 and L3 connected through the connection conductor TH12.

The innermost turns of the respective lines L1 and L3 are each ¾ turns, and the innermost turns of the respective lines L2 and L4 are each ¼ turns, so that the conductive pattern including the lines L1 and L4 has 11 turns in total and, similarly, the conductive pattern including the lines L2 and L3 has 11 turns in total. That is, two coils each having 11 turns are connected in parallel.

As a method for realizing an odd number of turns using two coil parts having mutually the same pattern shape as in the present embodiment, it can be thought that the number of turns of each coil part is set to N+0.5 turns (N is an integer); however, in this case, the connection conductors are concentrated on one position, which may make magnetic flux difficult to pass at this position depending on the situation. On the other hand, in the present embodiment, the planar positions of the respective connection conductors TH11 and TH12 differ from each other by an angular distance of 180°, revealing that the connection conductors are arranged in a distributed manner.

Further, in the coil component according to the present embodiment, the turns 101 to 106 and 201 to 206 are each radially divided into two parts by a spiral-shaped slit, so that non-uniformity in distribution of current density is reduced, which in turn can reduce DC resistance or AC resistance. In addition, the line L1 positioned at the outer peripheral side in the first coil part 100 is connected to the line L4 positioned at the inner peripheral side in the second coil part 200, and the line L2 positioned at the inner peripheral side in the first coil part 100 is connected to the line L3 positioned at the outer peripheral side in the second coil part 200, thereby eliminating an inner and outer peripheral difference. This makes the current density distribution more uniform, thereby allowing further reduction in DC resistance or AC resistance.

Further, the coil component according to the present embodiment is constituted by the first and second coil parts 100 and 200 having mutually the same planar shape, so that it is possible to produce the first and second coil parts 100 and 200 using masks having the same pattern shape, leading to reduction in manufacturing cost. In addition, the first and second coil parts 100 and 200 almost entirely overlap each other in a plan view, excluding the shift regions B1 and B2, so that it is possible to minimize visual interference between the first and second coil parts 100 and 200, regardless of whether the insulating substrate 10 is transparent or translucent. That is, when the first coil part 100 is subjected to appearance inspection, the second coil part 200 does not become a visual obstacle and, conversely, when the second coil part 200 is subjected to appearance inspection, the first coil part 100 does not become a visual obstacle. This allows appearance inspection using an inspection apparatus to be properly conducted.

Further, in the coil component according to the present embodiment, the outer and inner peripheral ends of the respective first and second coil parts 100 and 200 are disposed within the shift regions B1 and B2, respectively, so that even though the outer peripheral ends of the first coil part 100 and the outer peripheral ends of the second coil part 200 are adjacently disposed, it is possible to prevent an increase in the external dimensions of the coil part due to an increase in size of the circumferential regions A1 and A2 and a reduction in size of the coil inner diameter region.

Second Embodiment

Next, a coil component according to the second embodiment will be described. The coil component according to the second embodiment differs from the coil component according to the first embodiment in that the above-described first and second coil parts 100 and 200 are replaced with first and second coil parts 300 and 400, respectively. Other basic configurations are the same as those of the coil component according to the first embodiment.

Figure 5:
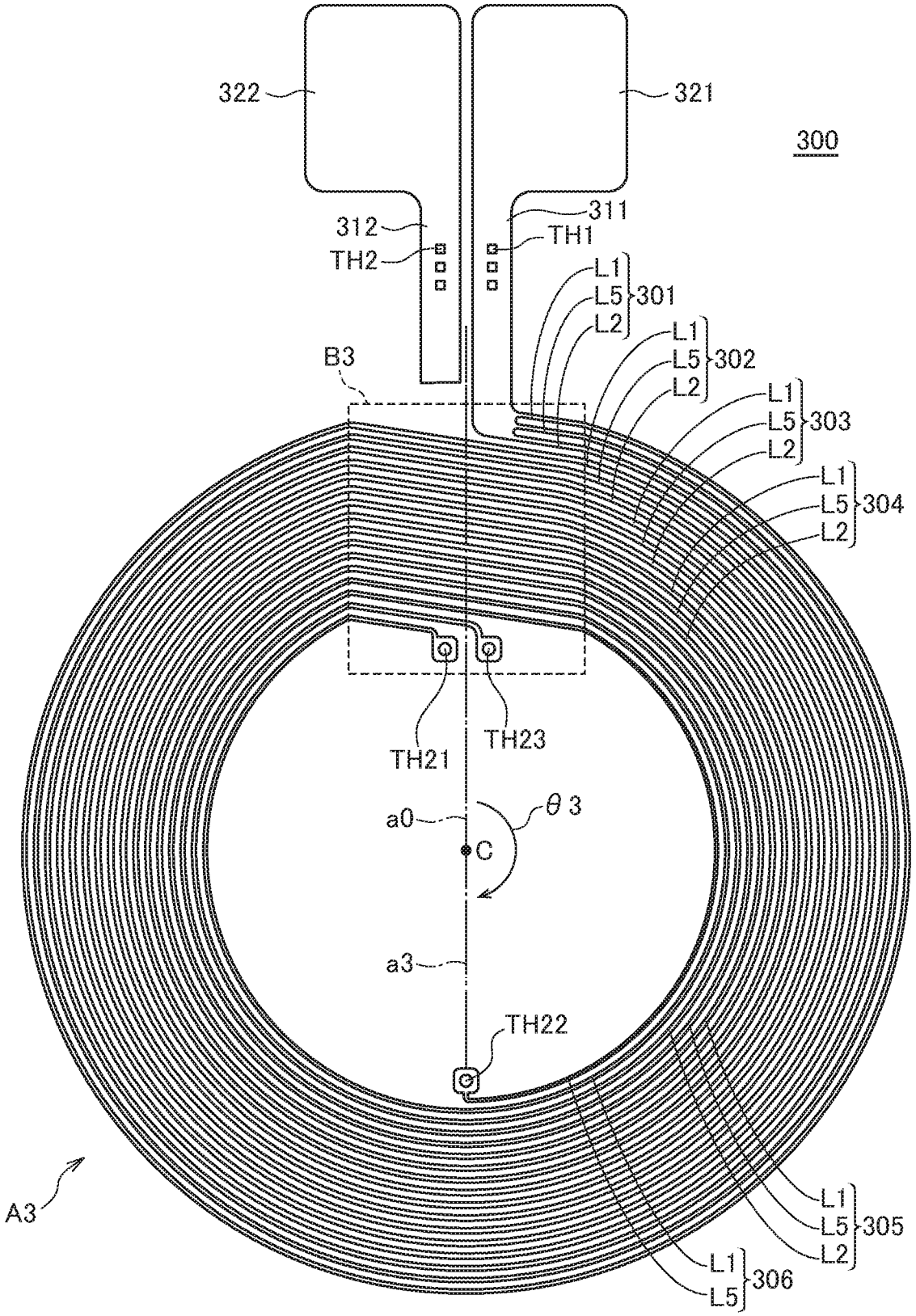
FIG. 5 is a plan view for explaining the pattern shape of the first coil part included in a second embodiment of the present invention as viewed from one surface side of the insulating substrate.
Figure 6:
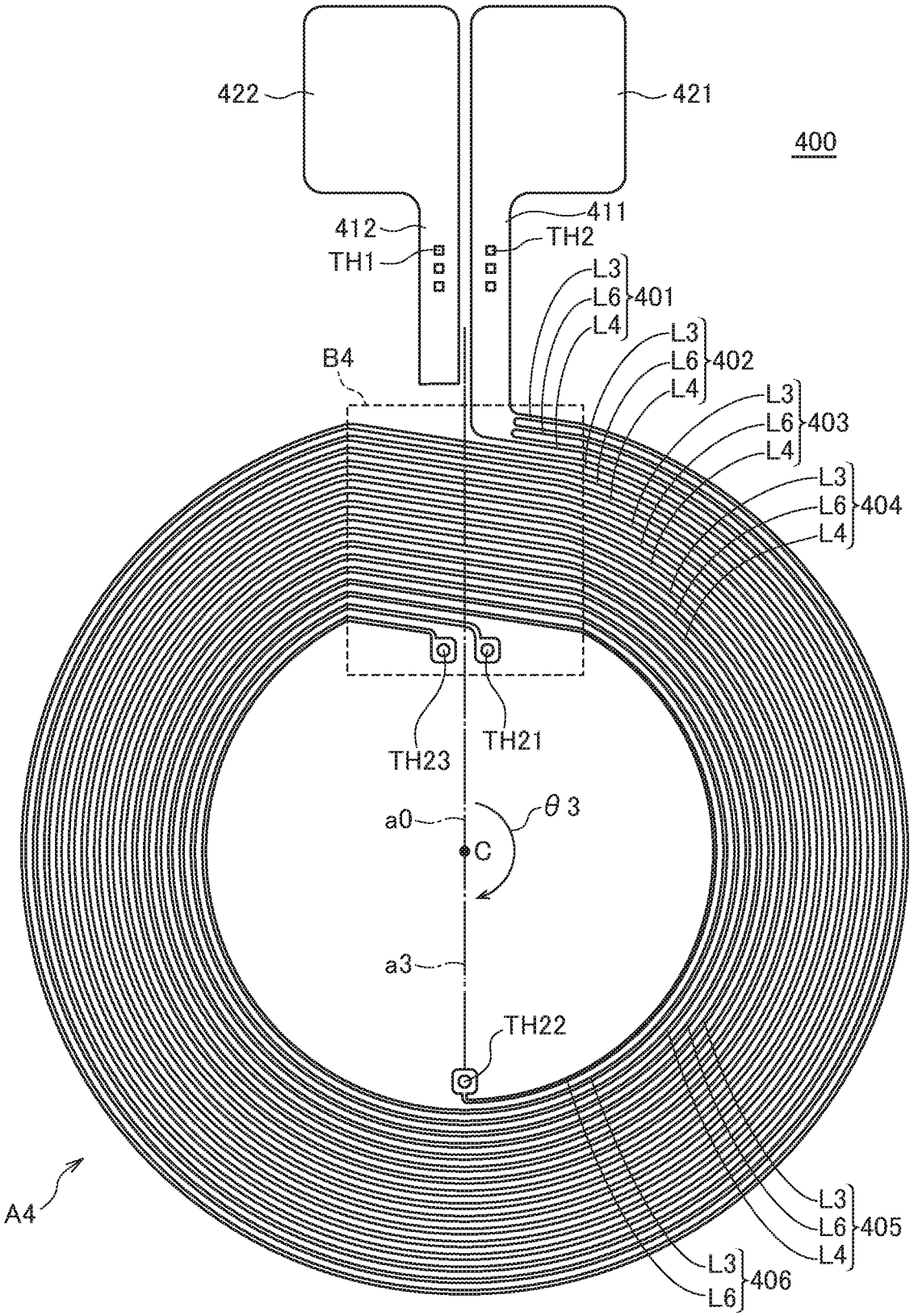
FIG. 6 is a plan view for explaining the pattern shape of the second coil part included in the second embodiment of the present invention as viewed from the other surface side of the insulating substrate.

FIG. 5 is a plan view for explaining the pattern shape of the first coil part 300 as viewed from the one surface 11 side of the insulating substrate 10. FIG. 6 is a plan view for explaining the pattern shape of the second coil part 400 as viewed from the other surface 12 side of the insulating substrate 10. In the present embodiment as well, the first and second coil parts 300 and 400 have the same pattern shape.

As illustrated in FIG. 5, the first coil part 300 has six turns including turns 301 to 306, in which the turn 301 is positioned at the outermost periphery, and the turn 306 is at the innermost periphery. The turns 301 to 306 are each divided into three lines L1, L5 and L2 by spiral-shaped slits. Of the three lines L1, L5 and L2, the line L1 is positioned at the outermost peripheral side, and the line L2 is positioned at the innermost peripheral side. The line L5 is radially sandwiched between the lines L1 and L2.

The outer peripheral end of the first coil part 300, i.e., the outer peripheral end of the turn 301 is connected to a terminal electrode 321 through a radially extending lead-out pattern 311. Further, a radially extending lead-out pattern 312 is disposed at a position peripherally adjacent to the lead-out pattern 311. The leading end of the lead-out pattern 312 is connected to a terminal electrode 322.

As illustrated in FIG. 5, the turns 301 to 305 constituting the first coil part 300 are each wound one round (360°). On the other hand, in the turn 306 positioned at the innermost periphery, the angular distance of the line L1 is one turn (360°), the angular distance of the line L5 is ½ turns (180°), and the angular distance of the line L2 is zero turns (0°). Accordingly, the total number of turns of the innermost peripheral turns of the lines L1, L5 and L2 is 1.5 turns. The line L2 may be considered to terminate at the turn 305. A connection conductor TH21 is provided at the inner peripheral end of the line L1, a connection conductor TH22 is provided at the inner peripheral end of the line L5, and a connection conductor TH23 is provided at the inner peripheral end of the line L2.

The turns 301 to 306 constituting the first coil part 300 each have a circumferential region A3 in which the radial position is not changed and a shift region B3 in which the radial position is shifted. The six turns including the turns 301 to 306 are defined with the shift region B3 as a boundary. As illustrated in FIG. 5, in the present embodiment, the outer peripheral end of the first coil part 300 and the inner peripheral ends of the lines L1 and L2 are positioned within the shift region B3. The connection conductors TH21 and TH23 provided at the inner peripheral ends of the respective lines L1 and L2 are positioned symmetrically with respect to the virtual line a0.

When a virtual line a3 radially extending from the center point C is assumed, the connection conductor TH22 provided at the inner peripheral end of the line L5 is on the virtual line a3. An angular distance θ3 between the virtual lines a0 and a3 is 180°.

The second coil part 400 has the same pattern shape as the first coil part 300. That is, the second coil part 400 has six turns including turns 401 to 406, in which the turn 401 is positioned at the outermost periphery, and the turn 406 is at the innermost periphery. The turns 401 to 406 are each divided into three lines L3, L6 and L4 by spiral-shaped slits. Of the three lines L3, L6 and L4, the line L3 is positioned at the outermost peripheral side, and the line L4 is positioned at the innermost peripheral side. The line L6 is radially sandwiched between the lines L3 and L6.

The outer peripheral end of the second coil part 400, i.e., the outer peripheral end of the turn 401 is connected to a terminal electrode 421 through a radially extending lead-out pattern 411. Further, a radially extending lead-out pattern 412 is disposed at a position peripherally adjacent to the lead-out pattern 411. The leading end of the lead-out pattern 412 is connected to a terminal electrode 422.

As illustrated in FIG. 6, the turns 401 to 405 constituting the second coil part 400 are each wound one round (360°). On the other hand, in the turn 406 positioned at the innermost periphery, the angular distance of the line L3 is one turn (360°), the angular distance of the line L6 is ½ turns (180°), and the angular distance of the line L4 is zero turns (0°). Accordingly, the total number of turns of the innermost peripheral turns of the lines L3, L6 and L4 is 1.5 turns. The line L4 may be considered to terminate at the turn 405. The connection conductor TH23 is provided at the inner peripheral end of the line L3, the connection conductor TH22 is provided at the inner peripheral end of the line L6, and the connection conductor TH21 is provided at the inner peripheral end of the line L4.

The turns 401 to 406 constituting the second coil part 400 each have a circumferential region A4 in which the radial position is not changed and a shift region B4 in which the radial position is shifted. The six turns including the turns 401 to 406 are defined with the shift region B4 as a boundary. The connection conductors TH23 and TH21 provided at the inner peripheral ends of the respective lines L3 and L4 are positioned symmetrically with respect to the virtual line a0. The connection conductor TH22 provided at the inner peripheral end of the line L6 is provided on the virtual line a3.

The thus configured first and second coil parts 300 and 400 are formed on the one surface 11 and the other surface 12 of the insulating substrate 10, respectively. The inner peripheral end of the line L1 is connected to the inner peripheral end of the line L4 through the connection conductor TH21, the inner peripheral end of the line L5 is connected to the inner peripheral end of the line L6 through the connection conductor TH22, and the inner peripheral end of the line L2 is connected to the inner peripheral end of the line L3 through the connection conductor TH23.

Figure 7:
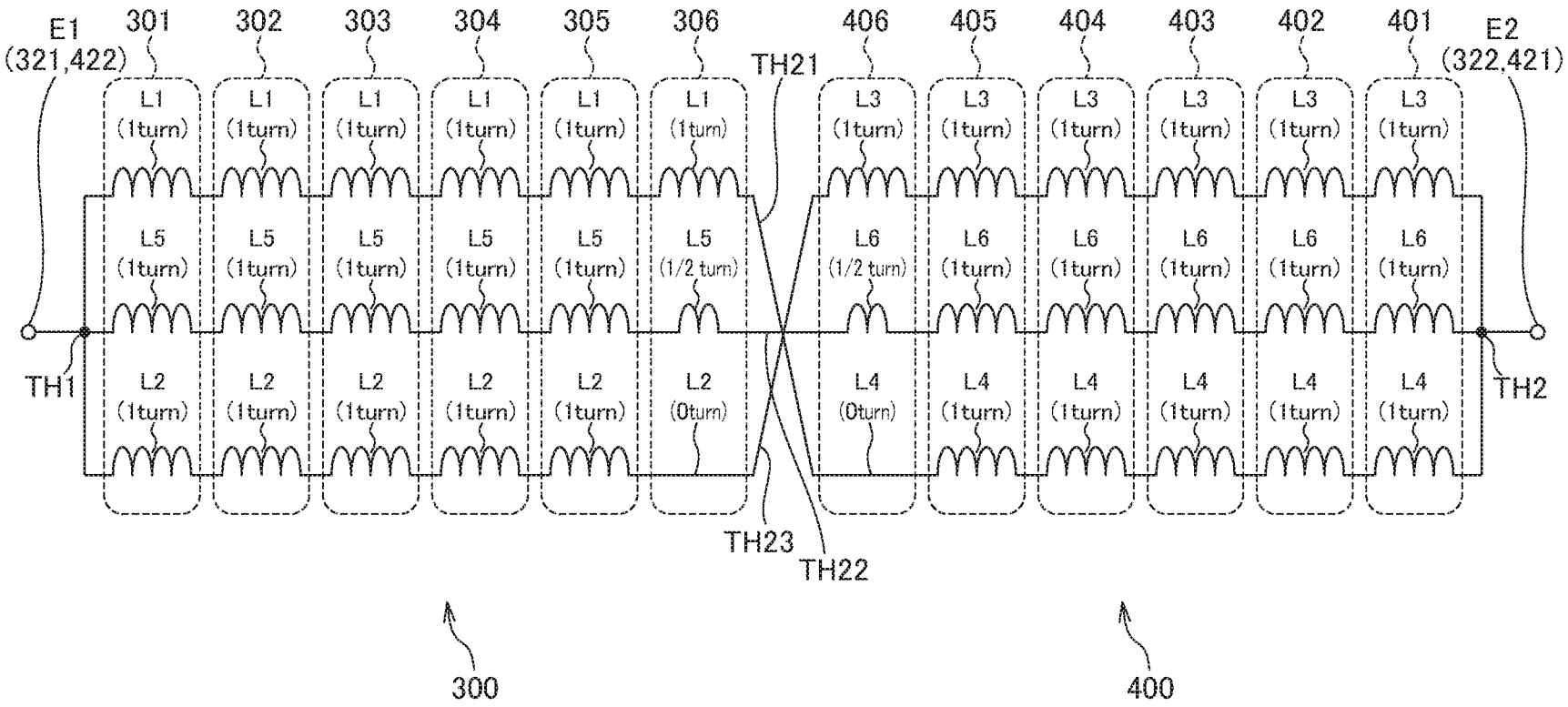
FIG. 7 is an equivalent circuit diagram of the coil component according to the second embodiment of the present invention.

FIG. 7 is an equivalent circuit diagram of the coil component according to the present embodiment.

As illustrated in FIG. 7, in the present embodiment, three conductive patterns are connected in parallel between terminal electrodes E1 and E2. The terminal electrode E1 is a terminal in which the terminal electrodes 321 and 422 are short-circuited by the connection conductor TH1, and the terminal electrode E2 is a terminal in which the terminal electrodes 322 and 421 are short-circuited by the connection conductor TH2. Of the three parallel-connected conductive patterns, the first conductive pattern includes the lines L1 and L4 connected through the connection conductor TH21, the second conductive pattern includes the lines L5 and L6 connected through the connection conductor TH22, and the third conductive pattern includes the lines L2 and L3 connected through the connection conductor TH23.

The innermost turns of the respective lines L1 and L3 are each one turn, the innermost turns of the respective lines L5 and L6 are each ½ turns, and the innermost turns of the respective lines L2 and L4 are each 0 turns, so that the first conductive pattern including the lines L1 and L4, the second conductive pattern including the lines L5 and L6 and the third conductive pattern including the lines L2 and L3 each have 11 turns in total. That is, three coils each having 11 turns are connected in parallel.

When it is intended to realize an odd number of turns using two coil parts having turns each divided into three lines, it is difficult to make the number of turns of the line (L5, L6) positioned at the radially intermediate position coincide with the number of turns of each of the other lines as far as the connection conductors are arranged concentratedly in one location. However, in the present embodiment, the innermost peripheral turns of the respective lines L5 and L6 positioned radially intermediate position are each ½ turns, allowing a configuration in which three coils each having 11 turns are connected in parallel to be easily realized. This method can be applied to all the cases where it is intended to realize an odd number of turns using two coil parts having turns each divided into an odd number of lines.

Further, in the coil component according to the present embodiment, the turns 301 to 306 and 401 to 406 are each radially divided into three parts by spiral-shaped slits, so that non-uniformity in distribution of current density is reduced even more than in the first embodiment, which in turn can further reduce DC resistance or AC resistance. In addition, the line L1 positioned at the outermost peripheral side in the first coil part 300 is connected to the line L4 positioned at the innermost peripheral side in the second coil part 400, and line L2 positioned at the innermost peripheral side in the first coil part 300 is connected to the line L3 positioned at the outermost peripheral side in the second coil part 400, thereby eliminating an inner and outer peripheral difference between the lines. This makes the current density distribution more uniform, thereby allowing a further reduction in DC resistance or AC resistance.

Comparing with the first embodiment, the positions of the terminal electrode (321 and 422) connected to the terminal electrode E1 and the terminal electrode (322 and 421) connected to the terminal electrode E2 are interchanged with those in the first embodiment. Thus, the positional relationship between the terminal electrodes can be arbitrarily determined.

Third Embodiment

Next, a coil component according to the third embodiment will be described. The coil component according to the third embodiment differs from the coil component according to the second embodiment in that the above-described first and second coil parts 300 and 400 are replaced with first and second coil parts 500 and 600, respectively. Other basic configurations are the same as those of the coil component according to the second embodiment.

Figure 8:
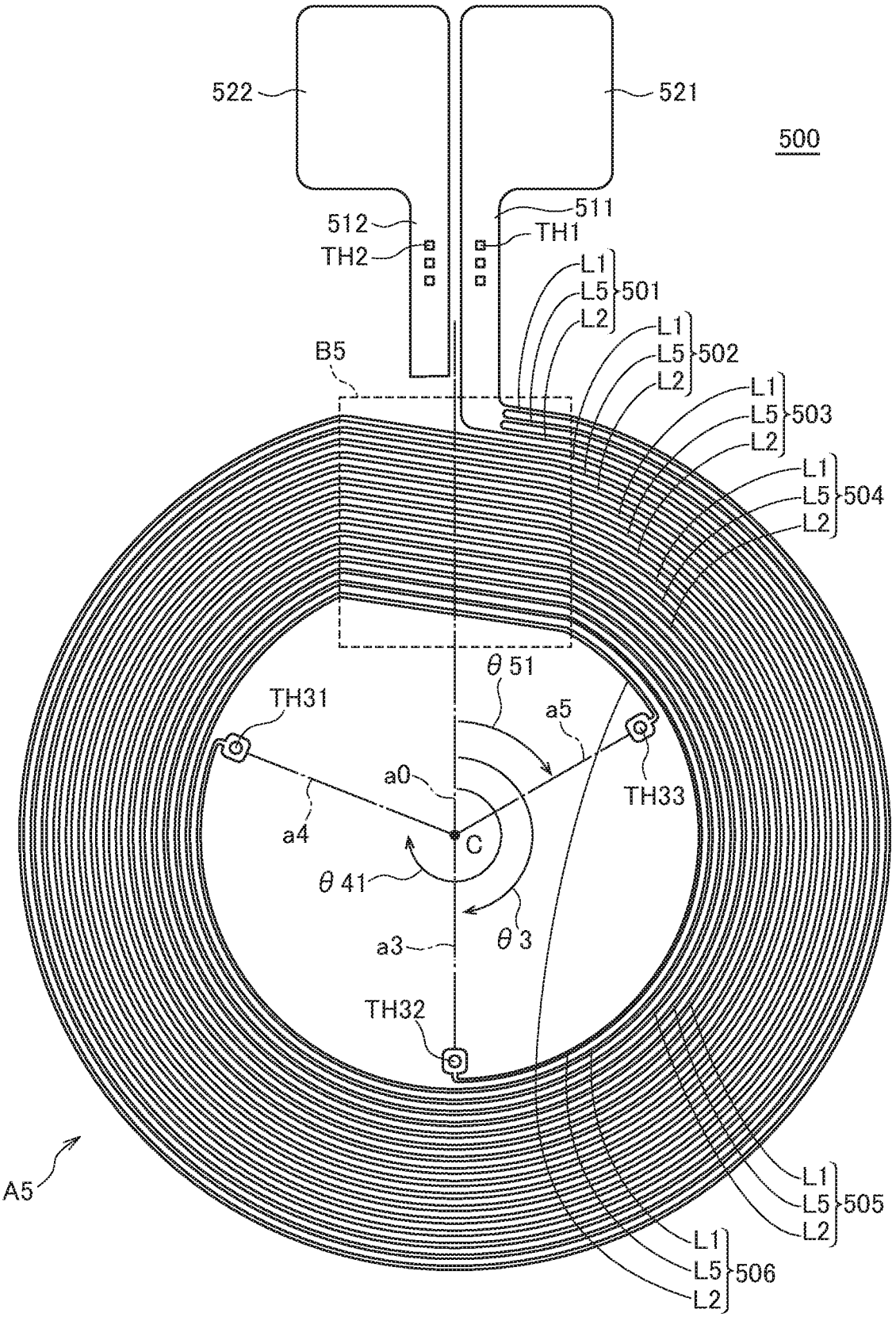
FIG. 8 is a plan view for explaining the pattern shape of the first coil part included in a third embodiment of the present invention as viewed from one surface side of the insulating substrate.
Figure 9:
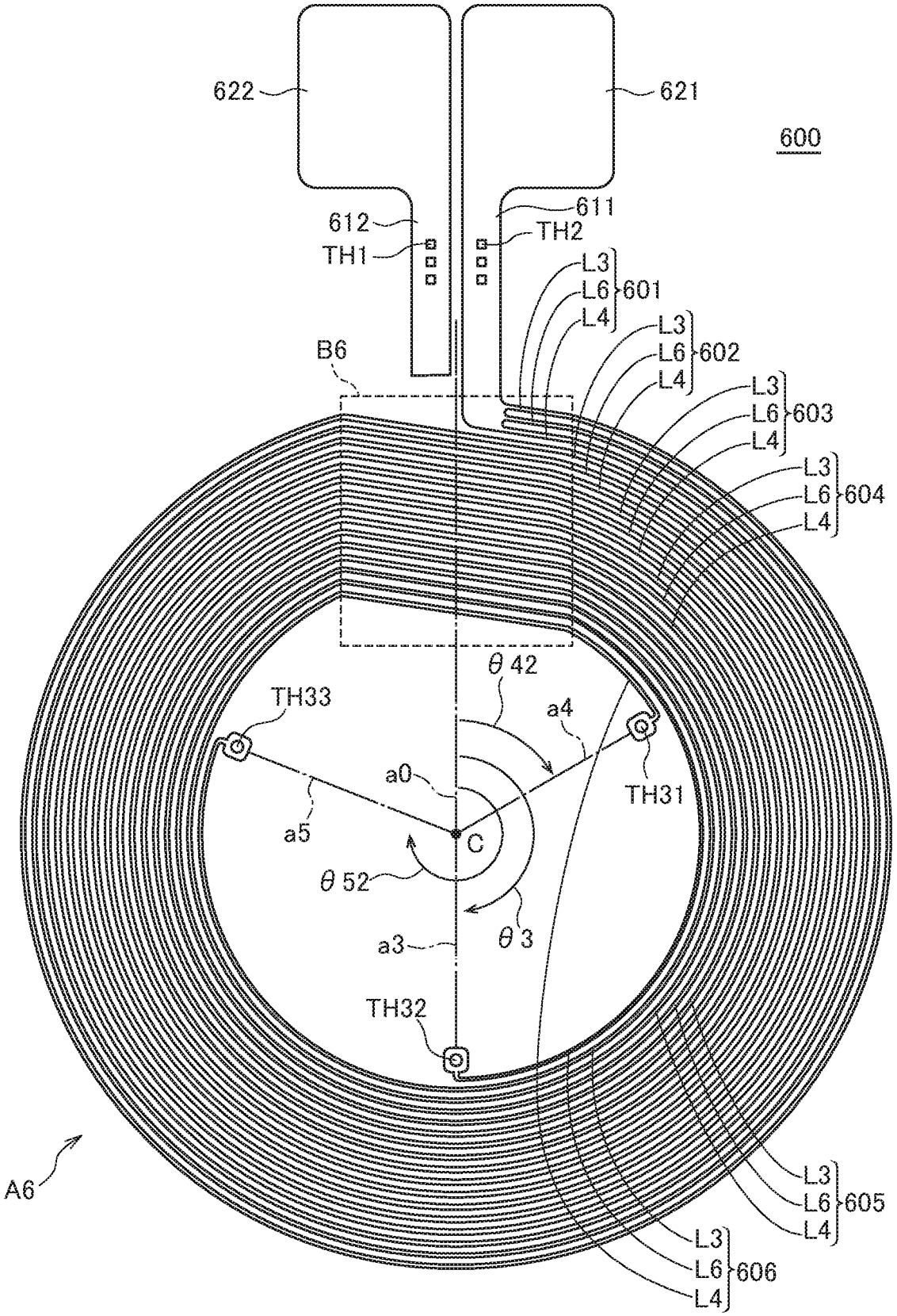
FIG. 9 is a plan view for explaining the pattern shape of the second coil part included in the third embodiment of the present invention as viewed from the other surface side of the insulating substrate.

FIG. 8 is a plan view for explaining the pattern shape of the first coil part 500 as viewed from the one surface 11 side of the insulating substrate 10. FIG. 9 is a plan view for explaining the pattern shape of the second coil part 600 as viewed from the other surface 12 side of the insulating substrate 10. In the present embodiment as well, the first and second coil parts 500 and 600 have the same pattern shape.

As illustrated in FIG. 8, turns 501 to 505 constituting the first coil part 500 are each wound one round (360°). On the other hand, in a turn 506 positioned at the innermost periphery, an angular distance θ41 of the line L1 is ⅚ turns (300°), an angular distance θ3 of the line L5 is ½ turns (180°), and an angular distance θ51 of the line L2 is ⅙ turns (60°). The angular distance θ41 is an angle formed by a virtual line a0 and a virtual line a4, and the angular distance θ51 is an angle formed by the virtual line a0 and a virtual line a5. The virtual lines a4 and a5 radially extend from the center point C. The virtual line a4 passes through the inner peripheral end of the line L1, and the virtual line a5 passes through the inner peripheral end of the line L2. Connection conductors TH31, TH32 and TH33 are provided at the inner peripheral ends of the lines L1, L5 and L2 of the turn 506, respectively.

The turns 501 to 506 constituting the first coil part 500 each have a circumferential region A5 in which the radial position is not changed and a shift region B5 in which the radial position is shifted. The six turns including the turns 501 to 506 are defined with the shift region B5 as a boundary. The connection conductors TH31 and TH33 provided at the inner peripheral ends of the respective lines L1 and L5 are positioned symmetrically with respect to the virtual line a0.

The second coil part 600 has the same pattern shape as the first coil part 500. That is, the turns 601 to 605 constituting the second coil part 600 are each wound one round (360°). On the other hand, in a turn 606 positioned at the innermost periphery, an angular distance θ52 of the line L3 is ⅚ turns (300°), an angular distance θ3 of the line L6 is ½ turns (180°), and an angular distance θ42 of the line L4 is ⅙ turns (60°). The angular distance θ42 is an angle formed by the virtual line a0 and the virtual line a4, and the angular distance θ52 is an angle formed by the virtual line a0 and the virtual line a5. The connection conductors TH33, TH32 and TH31 are provided at the inner peripheral ends of the lines L3, L6 and L4 of the turn 606, respectively.

The turns 601 to 606 constituting the second coil part 600 each have a circumferential region A6 in which the radial position is not changed and a shift region B6 in which the radial position is shifted. The six turns including the turns 601 to 606 are defined with the shift region B6 as a boundary. The connection conductors TH33 and TH31 provided at the inner peripheral ends of the respective lines L3 and L4 are positioned symmetrically with respect to the virtual line a0.

The thus configured first and second coil parts 500 and 600 are formed on the one surface 11 and the other surface 12 of the insulating substrate 10, respectively. The inner peripheral end of the line L1 is connected to the inner peripheral end of the line L4 through the connection conductor TH31, the inner peripheral end of the line L5 is connected to the inner peripheral end of the line L6 through the connection conductor TH32, and the inner peripheral end of the line L2 is connected to the inner peripheral end of the line L3 through the connection conductor TH33.

Figure 10:
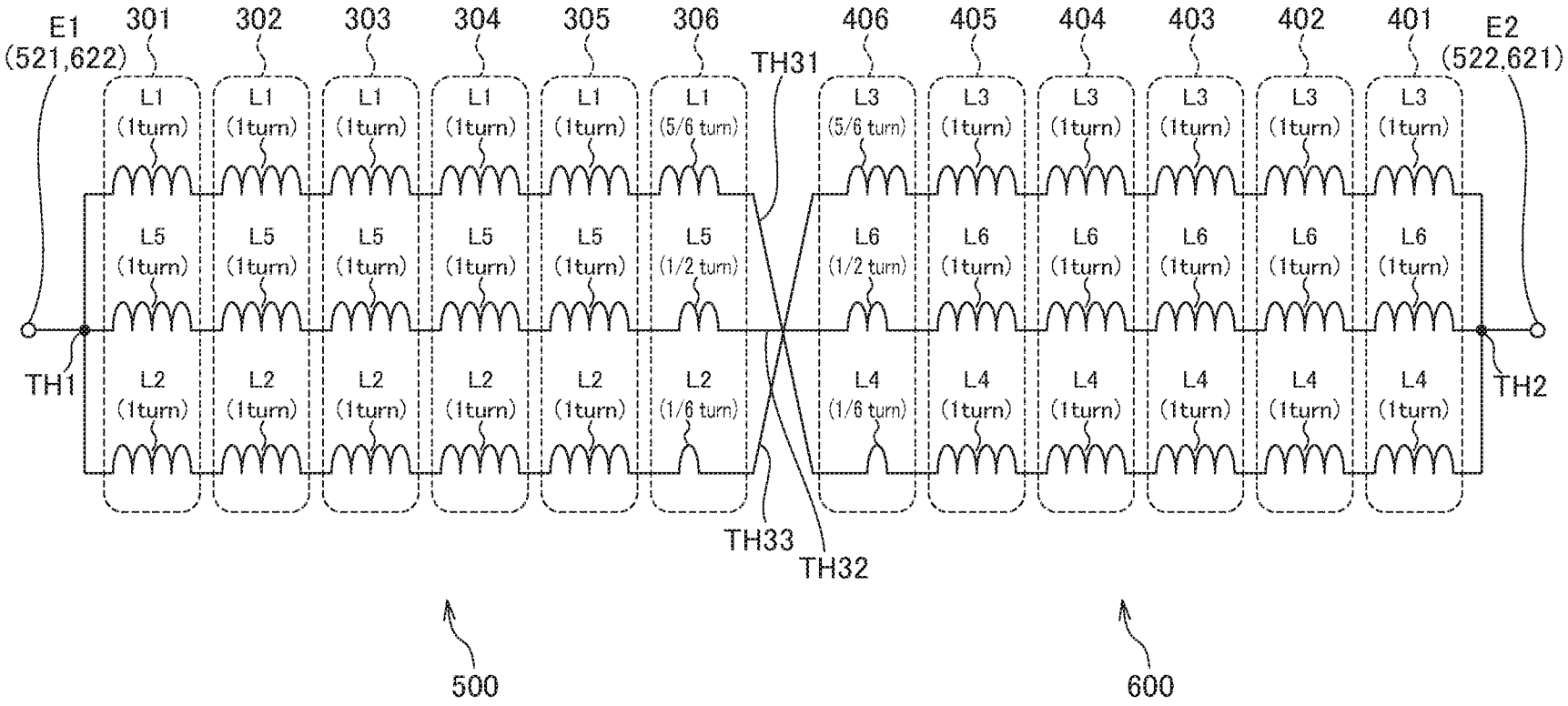
FIG. 10 is an equivalent circuit diagram of the coil component according to the third embodiment of the present invention.

FIG. 10 is an equivalent circuit diagram of the coil component according to the present embodiment.

As illustrated in FIG. 10, in the present embodiment, three conductive patterns are connected in parallel between terminal electrodes E1 and E2. The terminal electrode E1 is a terminal in which terminal electrodes 521 and 622 are short-circuited by the connection conductor TH1, and the terminal electrode E2 is a terminal in which terminal electrodes 522 and 621 are short-circuited by the connection conductor TH2. Of the three parallel-connected conductive patterns, the first conductive pattern includes the lines L1 and L4 connected through the connection conductor TH31, the second conductive pattern includes the lines L5 and L6 connected through the connection conductor TH32, and the third conductive pattern includes the lines L2 and L3 connected through the connection conductor TH33.

The innermost turns of the respective lines L1 and L3 are each ⅚ turns, the innermost turns of the respective lines L5 and L6 are each ½ turns, and the innermost turns of the respective lines L2 and L4 are each ⅙ turns, so that the first conductive pattern including the lines L1 and L4, the second conductive pattern including the lines L5 and L6, and the third conductive pattern including the lines L2 and L3 each have 11 turns in total. That is, three coils each having 11 turns are connected in parallel.

Thus, in the present embodiment, three connection conductors TH31 to TH33 are spaced apart from one another at 120° intervals. That is, the connection conductors are arranged in a more distributed manner.

Fourth Embodiment

Next, a coil component according to the fourth embodiment will be described. The coil component according to the fourth embodiment differs from the coil component according to the first embodiment in that the above-described first and second coil parts 100 and 200 are replaced with first and second coil parts 700 and 800, respectively. Other basic configurations are the same as those of the coil component according to the first embodiment.

Figure 11:
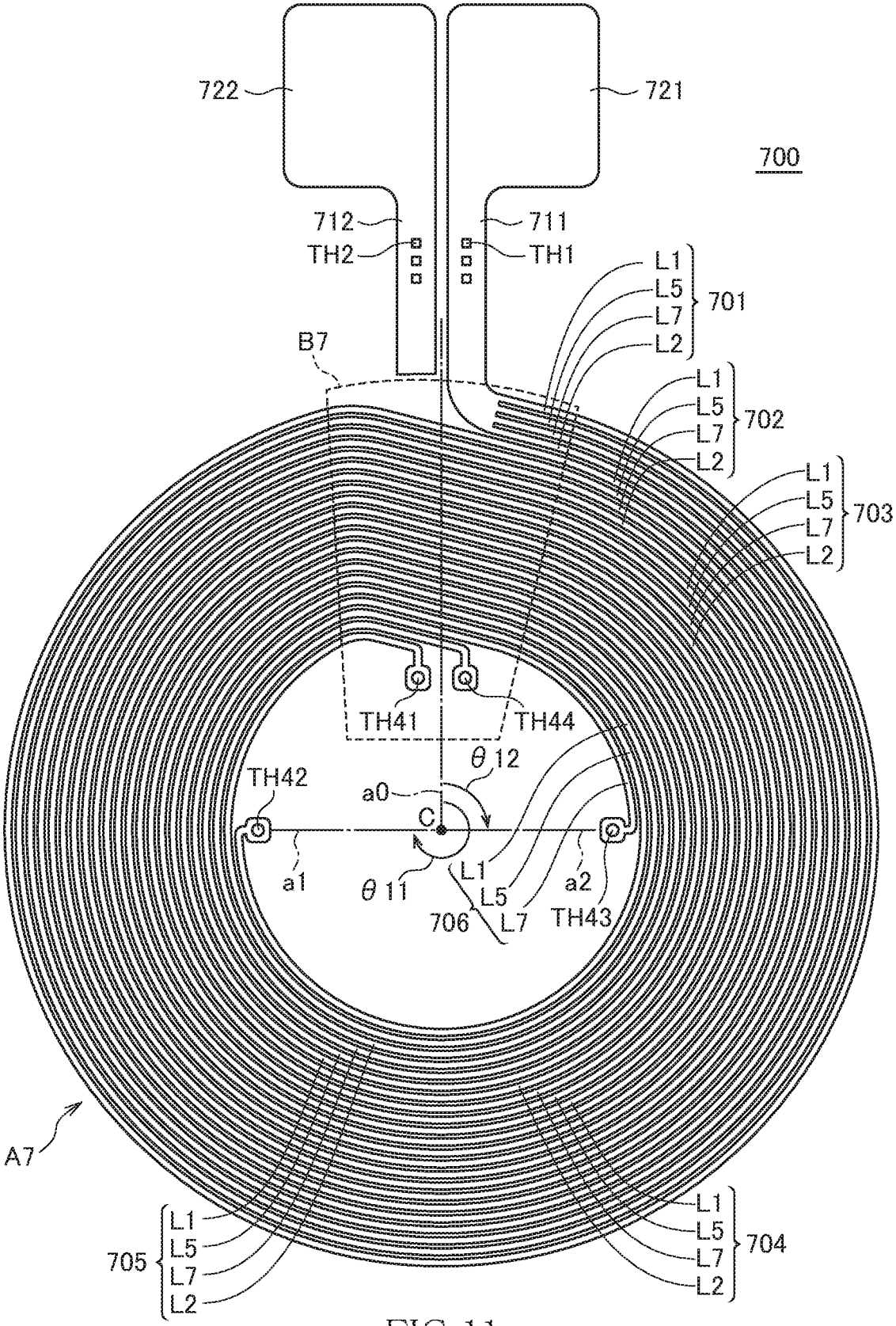
FIG. 11 is a plan view for explaining the pattern shape of the first coil part included in a fourth embodiment of the present invention as viewed from one surface side of the insulating substrate.
Figure 12:
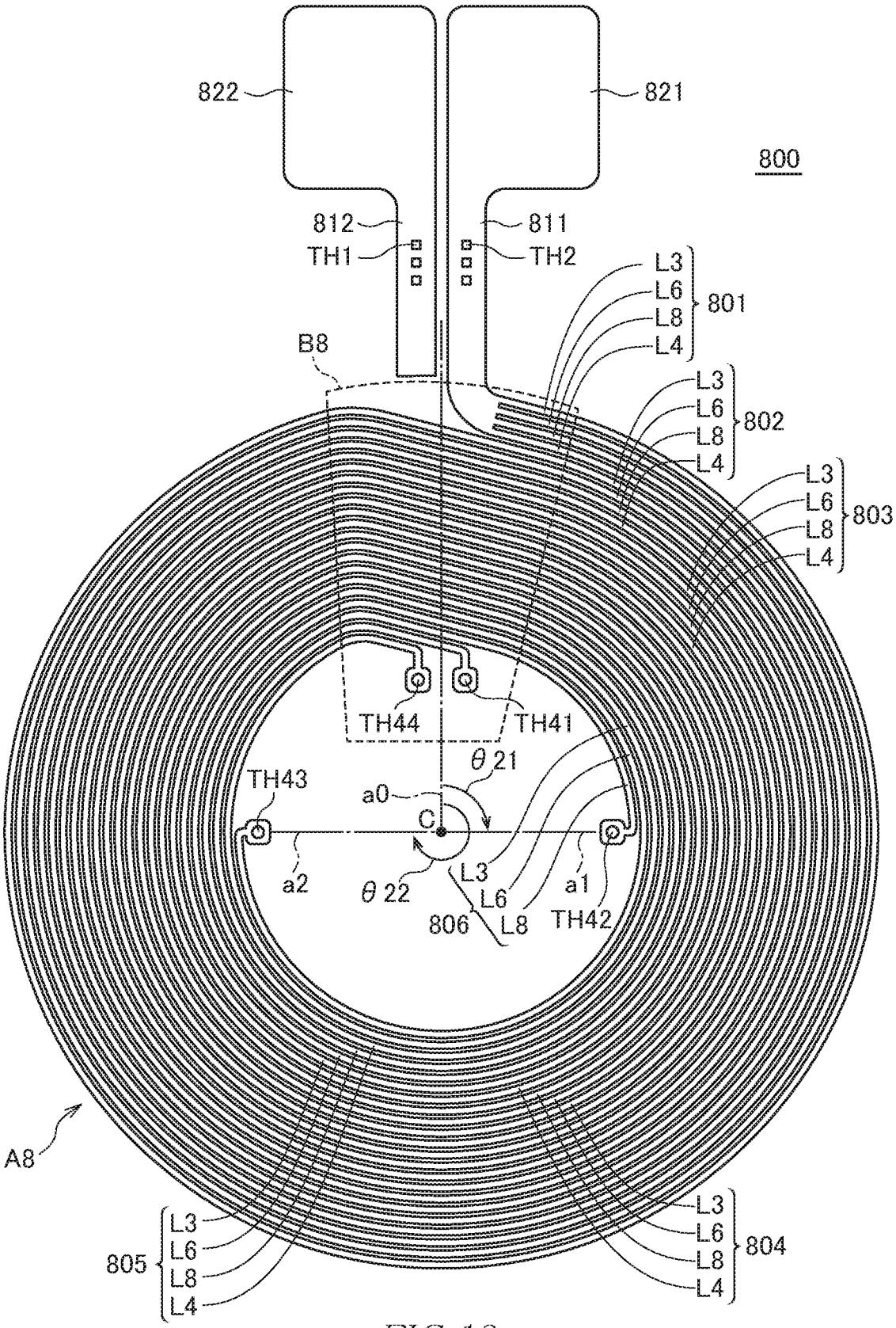
FIG. 12 is a plan view for explaining the pattern shape of the second coil part included in the fourth embodiment of the present invention as viewed from the other surface side of the insulating substrate.

FIG. 11 is a plan view for explaining the pattern shape of the first coil part 700 as viewed from the one surface 11 side of the insulating substrate 10. FIG. 12 is a plan view for explaining the pattern shape of the second coil part 800 as viewed from the other surface 12 side of the insulating substrate 10. In the present embodiment as well, the first and second coil parts 700 and 800 have the same pattern shape.

As illustrated in FIG. 11, the first coil part 700 has six turns including turns 701 to 706, in which the turn 701 is positioned at the outermost periphery, and the turn 706 is at the innermost periphery. The turns 701 to 706 are each divided into four lines L1, L5, L7 and L2 by spiral-shaped slits. Of the four lines L1, L5, L7 and L2, the line L1 is positioned at the outermost peripheral side, the line L5 is positioned at the second outermost peripheral side, the line L7 is positioned at the second innermost peripheral side, and the line L2 is positioned at the innermost peripheral side.

As illustrated in FIG. 11, the turns 701 to 705 constituting the first coil part 700 are each wound one round (360°). On the other hand, in the turn 706 positioned at the innermost periphery, the angular distance of the line L1 is one turn (360°), an angular distance θ11 of the line L5 is ¾ turns (270°), an angular distance θ12 of the line L7 is ¼ turns (90°), and the angular distance of the line L2 is zero turns (0°). Accordingly, the total number of turns of the innermost peripheral turns of the lines L1, L5, L7, and L2 is two turns. The line L2 may be regarded to terminate at the turn 705. Connection conductors TH41 to TH44 are provided at the inner peripheral ends of the respective lines L1, L5, L7 and L2 of the turn 706.

The turns 701 to 706 constituting the first coil part 700 each have a circumferential region A7 in which the radial position is not changed and a shift region B7 in which the radial position is shifted. The six turns including the turns 701 to 706 are defined with the shift region B7 as a boundary. The connection conductors TH41 and TH44 provided at the inner peripheral ends of the respective lines L1 and L2 are positioned symmetrically with respect to the virtual line a0, and the connection conductors TH42 and TH43 provided at the inner peripheral ends of the respective lines L5 and L7 are positioned symmetrically with respect to the virtual line a0. The connection conductors TH42 and TH43 are disposed on the virtual lines a1 and a2, respectively.

The second coil part 800 has the same pattern shape as the first coil part 700. That is, the second coil part 800 has six turns including turns 801 to 806, in which the turn 801 is positioned at the outermost periphery, and the turn 806 is at the innermost periphery. The turns 801 to 806 are each divided into four lines L3, L6, L8, and L4 by spiral-shaped slits. Of the four lines L3, L6, L8, and L4, the line L3 is positioned at the outermost peripheral side, the line L6 is positioned at the second outermost peripheral side, the line L8 is positioned at the second innermost peripheral side, and the line L4 is positioned at the innermost peripheral side.

As illustrated in FIG. 12, the turns 801 to 805 constituting the second coil part 800 are each wound one round (360°). On the other hand, in the turn 806 positioned at the innermost periphery, the angular distance of the line L3 is one turn (360°), an angular distance θ22 of the line L6 is ¾ turns (270°), an angular distance θ21 of the line L8 is ¼ turns (90°), and the angular distance of the line L4 is zero turns (0°). Accordingly, the total number of turns of the innermost peripheral turns of the lines L3, L6, L8 and L4 is two turns. The line L4 may be regarded to terminate at the turn 805. The connection conductors TH44 to TH41 are provided at the inner peripheral ends of the respective lines L3, L6, L8 and L4 of the turn 806.

The turns 801 to 806 constituting the second coil part 800 each have a circumferential region A8 in which the radial position is not changed and a shift region B8 in which the radial position is shifted. The six turns including the turns 801 to 806 are defined with the shift region B8 as a boundary. The connection conductors TH41 and TH44 provided at the inner peripheral ends of the respective lines L4 and L3 are positioned symmetrically with respect to the virtual line a0, and the connection conductors TH42 and TH43 provided at the inner peripheral ends of the respective lines L8 and L6 are positioned symmetrically with respect to the virtual line a0. The connection conductors TH42 and TH43 are disposed on the virtual lines a1 and a2, respectively.

The thus configured first and second coil parts 700 and 800 are formed on the one surface 11 and the other surface 12 of the insulating substrate 10, respectively. The inner peripheral end of the line L1 is connected to the inner peripheral end of the line L4 through the connection conductor TH41, the inner peripheral end of the line L5 is connected to the inner peripheral end of the line L8 through the connection conductor TH42, the inner peripheral end of the line L7 is connected to the inner peripheral end of the line L6 through the connection conductor TH43, and the inner peripheral end of the line L2 is connected to the inner peripheral end of the line L3 through the connection conductor TH44.

Figure 13:
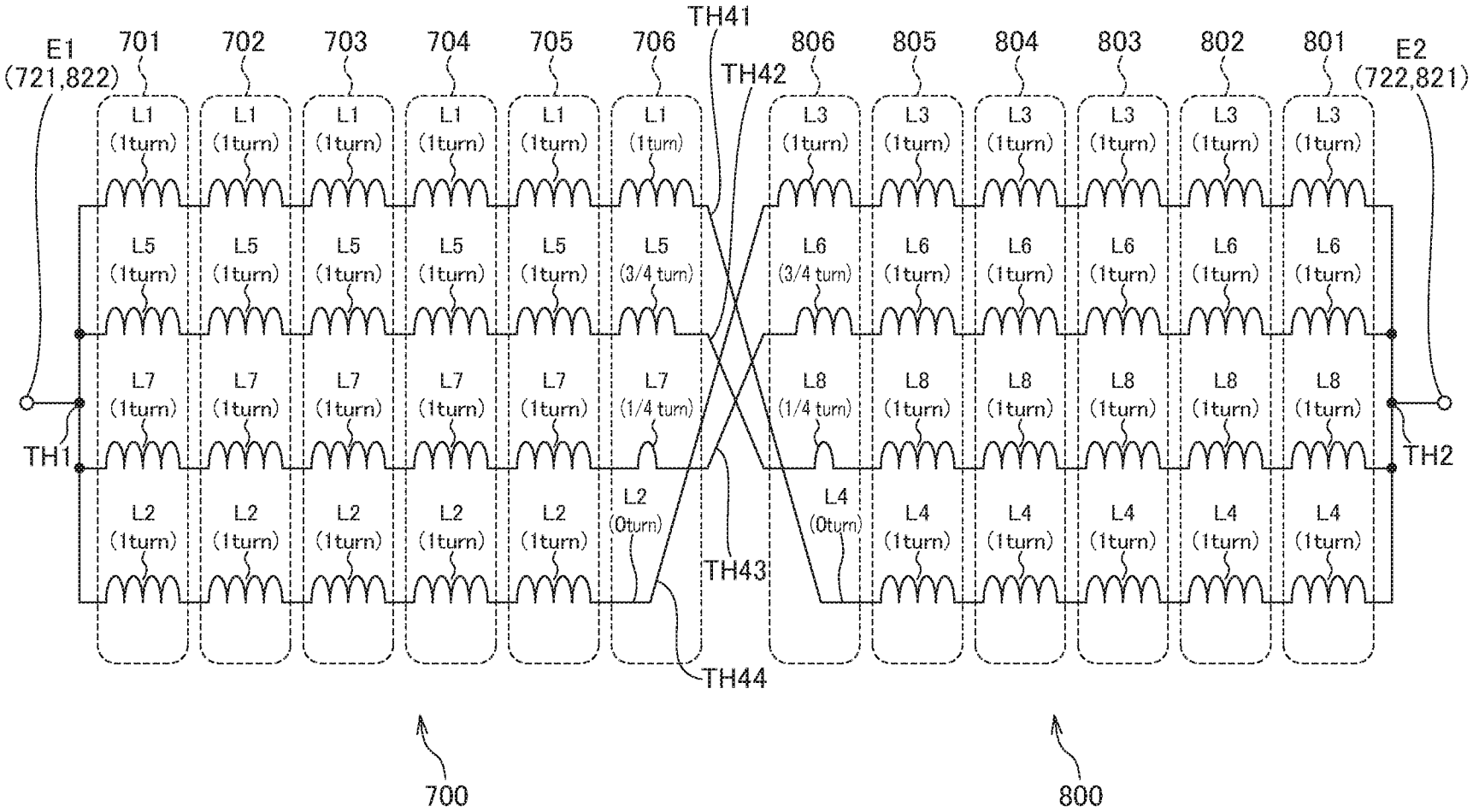
FIG. 13 is an equivalent circuit diagram of the coil component according to the fourth embodiment of the present invention.

FIG. 13 is an equivalent circuit diagram of the coil component according to the present embodiment.

As illustrated in FIG. 13, in the present embodiment, four conductive patterns are connected in parallel between terminal electrodes E1 and E2. The terminal electrode E1 is a terminal in which terminal electrodes 721 and 822 are short-circuited by the connection conductor TH1, and the terminal electrode E2 is a terminal in which terminal electrodes 722 and 821 are short-circuited by the connection conductor TH2. Of the four parallel-connected conductive patterns, the first conductive pattern includes the lines L1 and L4 connected through the connection conductor TH41, the second conductive pattern includes the lines L5 and L8 connected through the connection conductor TH42, the third conductive pattern includes the lines L7 and L6 connected through the connection conductor TH43, and the fourth conductive pattern includes the lines L2 and L3 connected through the connection conductor TH44.

The innermost turns of the respective lines L1 and L3 are each one turn, the innermost turns of the respective lines L5 and L6 are each ¾ turns, the innermost turns of the respective lines L7 and L8 are each ¼ turns, and the innermost turns of the respective lines L2 and L4 are each zero turns, so that the first conductive pattern including the lines L1 and L4, the second conductive pattern including the lines L5 and L8, the third conductive pattern including the lines L7 and L6, and the fourth conductive pattern including the lines L2 and L3 each have 11 turns in total. That is, four coils each having 11 turns are connected in parallel.

Thus, in the coil component according to the present embodiment, the turns 701 to 706 and 801 to 806 are each radially divided into four parts by spiral-shaped slits, so that non-uniformity in distribution of current density is reduced even more than in the first to third embodiments, which in turn can further reduce DC resistance or AC resistance. In addition, the line L1 positioned at the outermost peripheral side in the first coil part 700 is connected to the line L4 positioned at the innermost peripheral side in the second coil part 800, the line L5 positioned at the second outermost peripheral side in the first coil part 700 is connected to the line L8 positioned at the second innermost peripheral side in the second coil part 800, the line L7 positioned at the second innermost peripheral side in the first coil part 700 is connected to the line L6 positioned at the second outermost peripheral side in the second coil part 800, the line L2 positioned at the innermost peripheral side in the first coil part 700 is connected to the line L3 positioned at the outermost peripheral side in the second coil part 800, thereby eliminating an inner and outer peripheral difference between the lines. This makes the current density distribution more uniform, thereby allowing a further reduction in DC resistance or AC resistance.

It is apparent that the present invention is not limited to the above embodiments, but may be modified and changed without departing from the scope and spirit of the invention.

For example, although the two coil parts are formed on the front and back sides of the insulating substrate in the above embodiments, this is not an essential requirement in the present invention. Further, the two coil parts have the same pattern shape in the above embodiments, this is also not an essential requirement in the present invention.

Further, although all the turns of the two coil parts are divided into a plurality of lines by the spiral-shaped slit (or slits), this is not an essential requirement in the present invention, and all that needs to be done here is that at least the innermost turn is divided into a plurality of lines.

What is claimed is:

1. A coil component comprising:

a first coil part spirally wound in a plurality of turns; and a second coil part spirally wound in a plurality of turns, wherein at least an innermost peripheral turn of the first coil part is divided into a plurality of lines including first and second lines by a spiral-shaped slit, wherein at least an innermost peripheral turn of the second coil part is divided into a plurality of lines including third and fourth lines by a spiral-shaped slit, wherein a first angular distance of the innermost peripheral turn of the first line formed by a first virtual line and an inner peripheral end of the first line is larger than a second angular distance of the innermost peripheral turn of the second line formed by the first virtual line and an inner peripheral end of the second line, wherein a third angular distance of the innermost peripheral turn of the third line formed by a second virtual line and an inner peripheral end of the third line is larger than a fourth angular distance of the innermost peripheral turn of the fourth line formed by the second virtual line and an inner peripheral end of the fourth line, wherein the inner peripheral end of the first line is connected to the inner peripheral end of the fourth line, wherein the inner peripheral end of the second line is connected to the inner peripheral end of the third line, and wherein at least the innermost peripheral turn of each of the first and second coil parts is divided into n lines, where n is an integer more than 1, wherein a total angular distance of the n lines constituting the innermost peripheral turn of the first coil part is n/2 turns, and wherein a total angular distance of the n lines constituting the innermost peripheral turn of the second coil part is n/2 turns.

2. The coil component as claimed in claim 1, wherein the first line is positioned peripherally outside the second line, and wherein the third line is positioned peripherally outside the fourth line.

3. The coil component as claimed in claim 1, wherein at least the innermost peripheral turn of the first coil part is divided into three lines including the first and second lines, and a fifth line, wherein at least the innermost peripheral turn of the second coil part is divided into three lines including the third and fourth lines, and a sixth line, wherein any one of the first, second and fifth lines is ½ turns, and remaining two thereof are one turn in total, and wherein any one of the third, fourth, and sixth lines is ½ turns, and remaining two thereof are one turn in total.

4. The coil component as claimed in claim 3, wherein any one of the first, second and fifth lines is radially sandwiched between remaining two thereof, and wherein any one of the third, fourth and sixth lines is radially sandwiched between remaining two thereof.

5. The coil component as claimed in claim 1, wherein at least the innermost peripheral turn of the first coil part is divided into four lines including the first and second lines, and fifth and seventh lines, wherein at least the innermost peripheral turn of the second coil part is divided into four lines including the third and fourth lines, and sixth and eighth lines, wherein any two of the first, second, fifth and seventh lines are one turn in total, and remaining two thereof are one turn in total, and wherein any two of the third, fourth, sixth and eighth lines are one turn in total, and remaining two thereof are one turn in total.

6. The coil component as claimed in claim 1, wherein the first coil part is formed on one surface of an insulating substrate, and wherein the second coil part is formed on other surface of the insulating substrate.

7. The coil component as claimed in claim 6, wherein the substrate is transparent or translucent.

8. The coil component as claimed in claim 7, wherein each turn of the first and second coil parts has a circumferential region in which a radial position is not changed and a shift region in which the radial position is shifted, and wherein the circumferential region of each turn of the first coil part and the circumferential region of each turn of the second coil part coincide with each other in planar position.

9. A coil component comprising:

a first coil part spirally wound in a plurality of turns; and a second coil part spirally wound in a plurality of turns, wherein at least an innermost peripheral turn of the first coil part is divided into a plurality of lines including first and second lines by a spiral-shaped slit, wherein at least an innermost peripheral turn of the second coil part is divided into a plurality of lines including third and fourth lines by a spiral-shaped slit, wherein a first angular distance of the innermost peripheral turn of the first line formed by a first virtual line and an inner peripheral end of the first line is larger than a second angular distance of the innermost peripheral turn of the second line formed by the first virtual line and an inner peripheral end of the second line, wherein a third angular distance of the innermost peripheral turn of the third line formed by a second virtual line and an inner peripheral end of the third line is larger than a fourth angular distance of the innermost peripheral turn of the fourth line formed by the second virtual line and an inner peripheral end of the fourth line, wherein the inner peripheral end of the first line is connected to the inner peripheral end of the fourth line, wherein the inner peripheral end of the second line is connected to the inner peripheral end of the third line, wherein at least the innermost peripheral turn of each of the first and second coil parts is divided into n lines, where n is integer more than 1, wherein a total angular distance of the n lines constituting the innermost peripheral turn of the first coil part is n/2 turns, wherein a total angular distance of the n lines constituting the innermost peripheral turn of the second coil part is n/2 turns, wherein at least the innermost peripheral turn of the first coil part is divided into two lines including the first and second lines, wherein at least the innermost peripheral turn of the second coil part is divided into two lines including the third and fourth lines, wherein each of the innermost peripheral turns of the first and third lines is ¾ turns, and wherein each of the innermost peripheral turns of the second and fourth lines is ¼ turns.

* * * * *